US011845636B2

(12) United States Patent
Boxum

(10) Patent No.: US 11,845,636 B2
(45) Date of Patent: Dec. 19, 2023

(54) STAIR LIFT AND METHOD OF OPERATING A STAIR LIFT

(71) Applicant: TK HOME SOLUTIONS B.V., Krimpen aan den IJssel (NL)

(72) Inventor: Cornelis Boxum, Delfgauw (NL)

(73) Assignee: TK HOME SOLUTIONS B.V., Krimpen aan den Ijssel (NL)

( * ) Notice: Subject to any disclaimer, the term of this patent is extended or adjusted under 35 U.S.C. 154(b) by 332 days.

(21) Appl. No.: 17/250,195

(22) PCT Filed: Jun. 12, 2019

(86) PCT No.: PCT/EP2019/065312
§ 371 (c)(1),
(2) Date: Dec. 14, 2020

(87) PCT Pub. No.: WO2019/238736
PCT Pub. Date: Dec. 19, 2019

(65) Prior Publication Data

US 2021/0163263 A1 Jun. 3, 2021

(30) Foreign Application Priority Data

Jun. 14, 2018 (DE) ..... 10 2018 209 601.5

(51) Int. Cl.
*B66B 9/08* (2006.01)
*B66B 1/30* (2006.01)

(52) U.S. Cl.
CPC ..... *B66B 9/08* (2013.01); *B66B 1/30* (2013.01); *B66B 2201/405* (2013.01)

(58) Field of Classification Search
CPC ..... B66B 9/08; B66B 1/30; B66B 2201/405; B66B 1/468; B66B 2201/4676;
(Continued)

(56) References Cited

U.S. PATENT DOCUMENTS 4,674,601 A * 6/1987 Benjamin ..... B66B 9/00 14/71.3
4,904,916 A * 2/1990 Gisske ..... B66B 9/083 398/1
(Continued)

FOREIGN PATENT DOCUMENTS

DE 19513920 A1 10/1996
EP 2377795 A1 10/2011
(Continued)

OTHER PUBLICATIONS

Office Action dated Jun. 11, 2019 for German Application No. DE 10 2018 209 601.5.
(Continued)

*Primary Examiner* — Michael A Riegelman
(74) *Attorney, Agent, or Firm* — Dinsmore & Shohl LLP

(57) ABSTRACT

A stair lift includes a movable user carrier, an authentication device comprising a signal receiver and at least two signal emitters, wherein each emitter is assigned to a different user of the stairlift, operation adjustment means, for generating a behavioral profile of the stair lift, and a control unit for controlling the stairlift. A method of operating a stair lift includes authenticating one of at least two signal emitters assigned to a first user, and adjusting the behavioral profile of the stair lift according to a stored operation profile associated with the authenticated signal emitter.

17 Claims, 3 Drawing Sheets

(58) Field of Classification Search
CPC ..... B66B 2201/467; B66B 2201/4653; B66B 2201/4661; B66B 2201/4615
See application file for complete search history.

(56) References Cited

U.S. PATENT DOCUMENTS

| | | | | |
|---|---|---|---|---|
| 5,052,521 | A * | 10/1991 | Wendt | B66B 9/083 187/202 |
| 7,426,981 | B2 * | 9/2008 | Bacellar | B66B 5/0025 187/247 |
| 7,552,800 | B2 * | 6/2009 | Puskala | B66B 1/468 187/392 |
| 7,823,700 | B2 * | 11/2010 | Boss | B66B 1/468 187/247 |
| 7,882,938 | B2 * | 2/2011 | Blackaby | B66B 1/468 187/391 |
| 9,751,724 | B2 * | 9/2017 | Ooms | B66B 9/08 |
| 10,769,926 | B1 * | 9/2020 | Rogers | G08B 21/0461 |
| 11,401,133 | B2 * | 8/2022 | Boxum | B66B 9/0853 |
| 11,518,647 | B2 * | 12/2022 | Kurose | B66B 1/468 |
| 2008/0264730 | A1 * | 10/2008 | Blackaby | B66B 1/468 187/380 |
| 2010/0314201 | A1 * | 12/2010 | Stannah | B66B 9/0853 187/201 |
| 2011/0278096 | A1 * | 11/2011 | Kentenich | B66B 1/34 187/200 |
| 2015/0068847 | A1 * | 3/2015 | Ooms | H04W 8/22 187/201 |
| 2018/0044133 | A1 * | 2/2018 | Cook | B66B 1/30 |
| 2019/0382243 | A1 * | 12/2019 | van Eijgen | B66B 9/08 |
| 2020/0017332 | A1 * | 1/2020 | Boxum | B66B 9/0853 |
| 2020/0198928 | A1 * | 6/2020 | Kasbergen | B66B 5/0006 |
| 2021/0163263 | A1 * | 6/2021 | Boxum | B66B 9/08 |
| 2021/0323791 | A1 * | 10/2021 | Kasbergen | B66B 9/08 |
| 2022/0315386 | A1 * | 10/2022 | Lampe | H02J 7/0042 |

FOREIGN PATENT DOCUMENTS

| | | | | |
|---|---|---|---|---|
| EP | 3290374 | A1 | 3/2018 | |
| WO | WO-2005047142 | A1 * | 5/2005 | B66B 25/00 |
| WO | 2006112812 | A2 | 10/2006 | |
| WO | 2013137730 | A1 | 9/2013 | |

OTHER PUBLICATIONS

International Search Report dated Oct. 8, 2019 for International Application No. PCT/EP2019/065312.

* cited by examiner a)

b)

STAIR LIFT AND METHOD OF OPERATING A STAIR LIFT

CROSS REFERENCE TO RELATED APPLICATIONS

This application is a U.S. National Stage Entry of International Patent Application Serial Number PCT/EP2019/065312, filed Jun. 12, 2019, which claims priority to German Patent Application No. DE 10 2018 209 601.5, filed Jun. 14, 2018, 2018, the entire contents of each of which are incorporated herein by reference.

FIELD

The present disclosure generally relates to passenger boarding bridges for aircraft, including a method for automated docking of a passenger boarding bridge to an aircraft.

BACKGROUND

A stair lift is a product which is typically meant for people with impaired mobility, mostly elderly people, to provide a means to get upstairs and downstairs without removing the staircase and thus maintaining the functionality of the stairs for persons which can climb the stairs themselves. The stair lift is in most cases installed in people's homes and typically comprises a user carrier, as for example a chair or a wheel chair platform, driven by a drive unit which is arranged to drive the user carrier along the rail, mounted on or along one or more flights of a staircase.

Patent document WO 2005/087644 discloses a stair lift equipped with an automatic swivel functionality, which rotates the chair of the stairlift around a vertical axis during the ride in order to be able to move through narrow staircases.

This swivelling functionality can also be used in embarking stations, to rotate the chair away from the staircase flight before the user steps on or off the chair. These swivelling functionalities and also the speed profile of the chair can be programmed in the drive unit but are linked to the position of the drive on the rail of the stair lift.

Stair lifts, however, can also be installed in a staircase which provides access to multiple homes and can be used by different users. Some of these users might consider following the programmed swivelling functionalities and speed profile of the chair throughout several flights of the staircase inconvenient.

Therefore, a need exists to provide a stair lift and method of operating a stair lift that is better adapted to different users' needs and/or requirements.

DETAILED DESCRIPTION

Figure 1:
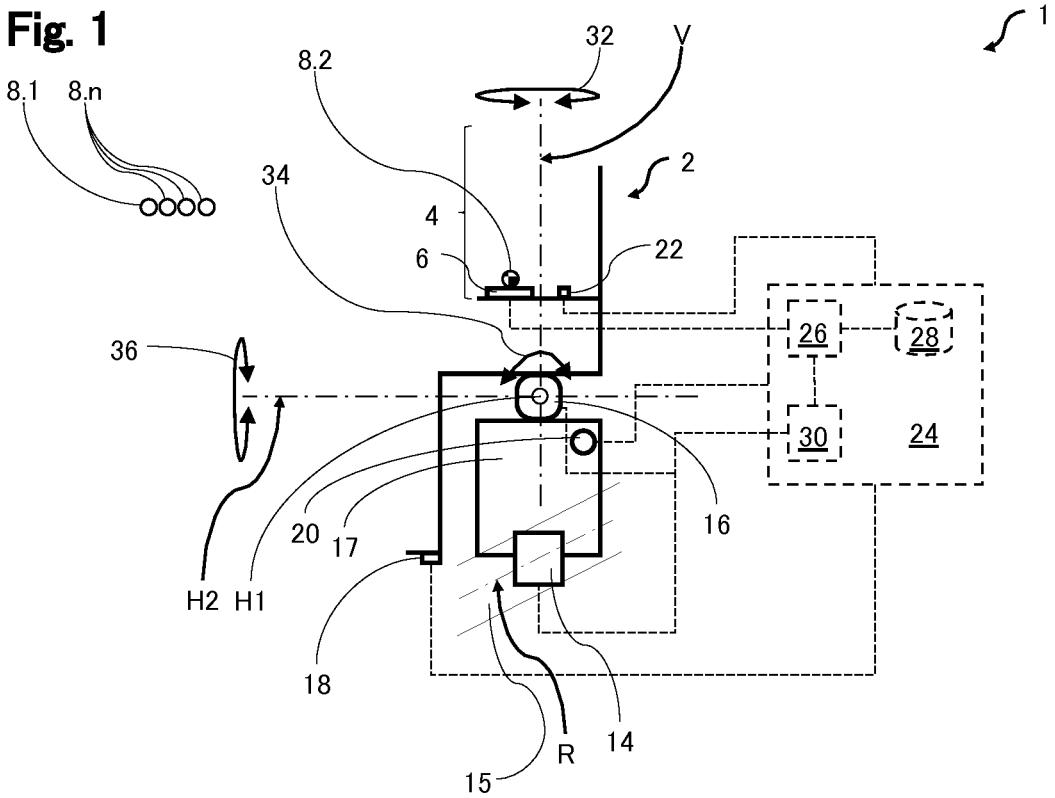
FIG. 1 is a schematic side view of an exemplary embodiment of a stair lift of the present disclosure, depicting the user carrier and a corresponding section of a guiding rail.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting "a" element or "an" element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

The present disclosure generally relates to an elevator system having at least one elevator shaft and at least one elevator car that is displaceable in the shaft. The present disclosure further relates to a service vehicle for an elevator system and a method for extracting an elevator car from an elevator shaft.

According to one aspect, the invention provides a stair lift, comprising a) a movable user carrier, b) an authentication device comprising a signal receiver and at least two signal emitters, wherein each emitter is assigned to a different user of the stairlift, c) operation adjustment means, for generating a behavioral profile of the stair lift, d) a control unit for controlling the stairlift, particularly for controlling the authentication device and the operation adjustment means.

The control unit is arranged to adjust the behavioral profile of the stair lift, particularly of the user carrier, depending on the signal emitter authenticated by the authentication device, particularly based on which of the signal emitters has been authenticated. Particularly, a signal emitter is considered authenticated after making the respective contact with the signal receiver. The period in which the authentication stays valid may be determined by a certain amount of time, a continuing presence of the signal receiver and/or a subsequent authentication of the different signal emitter, according to different embodiments.

According to another aspect, the invention provides a method of operating a stair lift, particularly of a stairlift according to an embodiment of the invention, comprising at least the steps of: i) authenticating a signal emitter assigned to a certain user, ii) adjusting the behavioral profile of the stair lift, particularly of the user carrier, depending on the authenticated signal emitter (i.e. particularly depending on which of the signal emitters has been (and is still) authenticated).

The invention is based on the finding that different users of a stairlift in a certain staircase may desire different modes of operation whilst using the stairlift. The desired differences in stairlift operation might be with respect to movement details of the user carrier, aspects of the stair lift's human machine interface, or providing personalized safety features.

For example: in case one user lives on the 4th floor of a staircase and the user starts his/her ride on the stairlift on the ground floor, it might be convenient for the user to swivel (swivel=rotate around a vertical axis or an axis with a vertical component) the chair in front of his/her own front door on the 4th floor, but not at each intermediate floor between the other flights of the staircase. It might also be convenient for that user to ride at a relatively large speed of the user carrier without stopping the drive at each intermediate floor. For a different user living on the $2^{nd}$ floor it might be convenient to rotate the chair only at the $2^{nd}$ floor and travel at a lower speed for instance.

The invention offers the idea of combining authenticating a user (who wants his ride using the stair lift adapted to his needs/requirements/desires) and providing an adaptation infrastructure (i.e. operation adjustment means) for influencing different kinds of operational behavior of the stair lift. According to an embodiment of the invention, a control infrastructure is therefore provided that allows for the operation adjustment means to be controlled in a way it suits the specifications provided by the user that is currently authenticated.

Once a certain user has been authenticated as the current user of the stair lift, the operation adjustment mean(s) relevant to adjust the behavioral aspects of the stair lift that are relevant to the user's behavioral profile, can be adjusted deploying the control unit. For the invention to function, it is not necessary that a certain number or all operation adjustment means are deployed for adjusting the behavioral profile.

Particularly, the information on the aspects of the behavioral profile that are relevant to the user and on the specific characteristics the user requires/desires have been accumulated and stored in a database the control not means has access to. Filling such a database with respect to a certain user's preferences particularly can be performed before the use of the stair lift, for example during a sign-up process of/for the user.

For being able to adjust different aspects of the behavioral profile of the user carrier, the operation adjustment means can comprise different types of adjustment means. According to an embodiment, the operation adjustment means comprise

- movement adjustment means, particularly with respect to swivelling, tilting (tilting=rotating around a horizontal axis or an axis with a horizontal component) and/or speed of the user carrier, for generating a movement profile of the user carrier, and/or
- interaction adjustment means, particularly with respect to adjusting a language or a mode or a style of an interaction interface of the user carrier, for generating an interaction profile of the user carrier, and/or
- surroundings adjustment means, particularly with respect to lighting of the user carrier's surrounding, for generating a surroundings profile of the user carrier.

In order for the invention to be used with different types of stair lifts, the user carrier according to an embodiment comprises a chair and/or a wheelchair platform and/or a standing platform. A user carrier having a standing platform can support a user by transporting him/her standing on the platform and/or by providing support with respect to leaning and/or resting their arms and/or their back and/or their sides on the platform while walking up or down the stairs themselves. The latter concept itself is also referred to as a stair walker. Without limiting the scope of the invention, the invention is described for a stair lift having a swivelable and/or tiltable chair in the following.

According to an embodiment, the authentication device is of an RFID authentication type. Particularly, the signal receiver of the authentication device comprises an RFID tag reader and the signal emitters of the authentication device each comprise an RFID tag, wherein each of the RFID tags has a different ID, which is particularly distinguishable by the RFID tag reader.

The term "authentication device" is to be understood in a broad sense, particularly also including authentication means/methods that do not require separate hardware, as for example an authentication of biometric features, for example a finger print or an iris scan, but instead deploying hardware that is present at the stairlift anyway, for example a touchscreen or a camera. According to an embodiment, the authentication device can be any kind of one-lock multiple-keys system, deploying a wireless and/or physical lock and different wireless and/or physical keys.

To provide simple and quick authentication, according to an embodiment the signal receiver is arranged at, particularly attached to, the user carrier, particularly at an armrest. In case longer-range RFID components are used, the signal receiver may also be arranged at, particularly attached to, a backrest or a seat or a platform of the user carrier.

According to different embodiments, there are different aspects of the behavioral profile of the stairlift prone to be adjusted within the scope of the invention. Particularly, adjusting behavior of the stair lift may include movement aspects and/or interaction aspects and/or surroundings aspects. By covering one of these aspects, a very precise adjustment of the stair lift's operation can be attained; by covering more of these aspects, a more general adjustment.

Below, several types of operation adjustment means for adjusting the behavioral profile are described exemplary. According to an embodiment, each of these adjustment means can be applied separately or combined with one or more of the other adjustment means.

In order to adjust the way the user carrier moves through the staircase, according to an embodiment adjusting the behavioral profile comprises adjusting a movement profile of the stair lift.

Particularly, adjusting the movement profile comprises adjusting a stair lift speed profile. Thus, different levels of confidence with respect to travel speed in the staircase existing in different uses can be considered. Particularly, a speed of the movement of the user carrier along the guidance rail can be adjusted according to the user's preferences, for example separately for in-flight travel and on-floor travel. Particularly, different speed patterns can be applied on floors that are irrelevant to the user on the one hand and floors that are relevant to the user on the other hand. Exemplarily, a speed profile might include a stop at the designated arrival floor, but no stop on floors between the starting floor and the arrival floor.

Additionally or alternatively, adjusting the movement profile comprises adjusting a swivelling profile of the user carrier. Particularly, a swivelling movement of the user carrier may be applied during in-flight travel in case of a narrow passage in the staircase in order to avoid a collision of the user with a staircase wall or the like. Particularly, such swivelling adjustment is applied depending on certain body size or proportion features of the user. Thereby, the movement profile of a taller user might for instance comprise more swivelling than the movement profile of a smaller user.

Particularly, the user carrier can be swivelled on a certain floor, especially to swivel the user away from the neighboring flight of stairs and/or to direct the user towards his probable direction of exiting the user carrier.

Additionally or alternatively, adjusting the movement profile comprises adjusting a tilt profile of the user carrier. Particularly, a tilting movement of the user carrier may be applied during in-flight travel in case of a narrow passage in the staircase in order to avoid a collision of the user with the wall or the like. Particularly, such a tilting adjustment is applied depending on certain body size or proportion features of the user. Thereby, the movement profile of a taller user might comprise more tilting than the movement profile of a smaller user. Tilting can also be used for facilitating user ascent on the user carrier and descent from the user carrier.

According to an embodiment, the movement profile comprises a combined adjustment of a swivelling and tilting profile of the user carrier.

In order to adjust the way the user carrier interacts with the staircase it moves through and/or affects the staircase or other components surrounding it, according to an embodiment adjusting the behavioral profile comprises adjusting a surroundings profile of the stairlift.

Particularly, adjusting the surroundings profile comprises adjusting a stair lift lighting, particularly its brightness profile and/or its lighting pattern. Thus, a visually impaired user of the stairlift for example can be provided with sufficient lighting to visually percept the surroundings of the user carrier.

In order to adjust the way the user carrier interacts with the authenticated user, according to an embodiment adjusting the behavioral profile comprises adjusting an interaction profile of the stair lift.

Particularly, adjusting the interaction profile comprises adjusting emergency details, particularly telephone numbers to be contacted in case of a user emergency, and/or adjusting a voice signal profile, particularly for user information. Such features allow for improving passive safety of the authenticated user and/or improving human machine interaction.

To make sure the stairlift can be operated by non-authenticated users, a standard behavioral profile is (re-)applied in case no signal emitter is authenticated, particularly during an anonymous use and/or in case an authenticated signal emitter is removed. Especially in public staircases, such a feature is useful in order to provide personalized rides for frequent users (or known users that can be authenticated using a personal signal emitter linked to their personal behavioral profile that has been previously stored in the stair lift's control unit), but also normal rides for unknown chance users.

Figure 3:
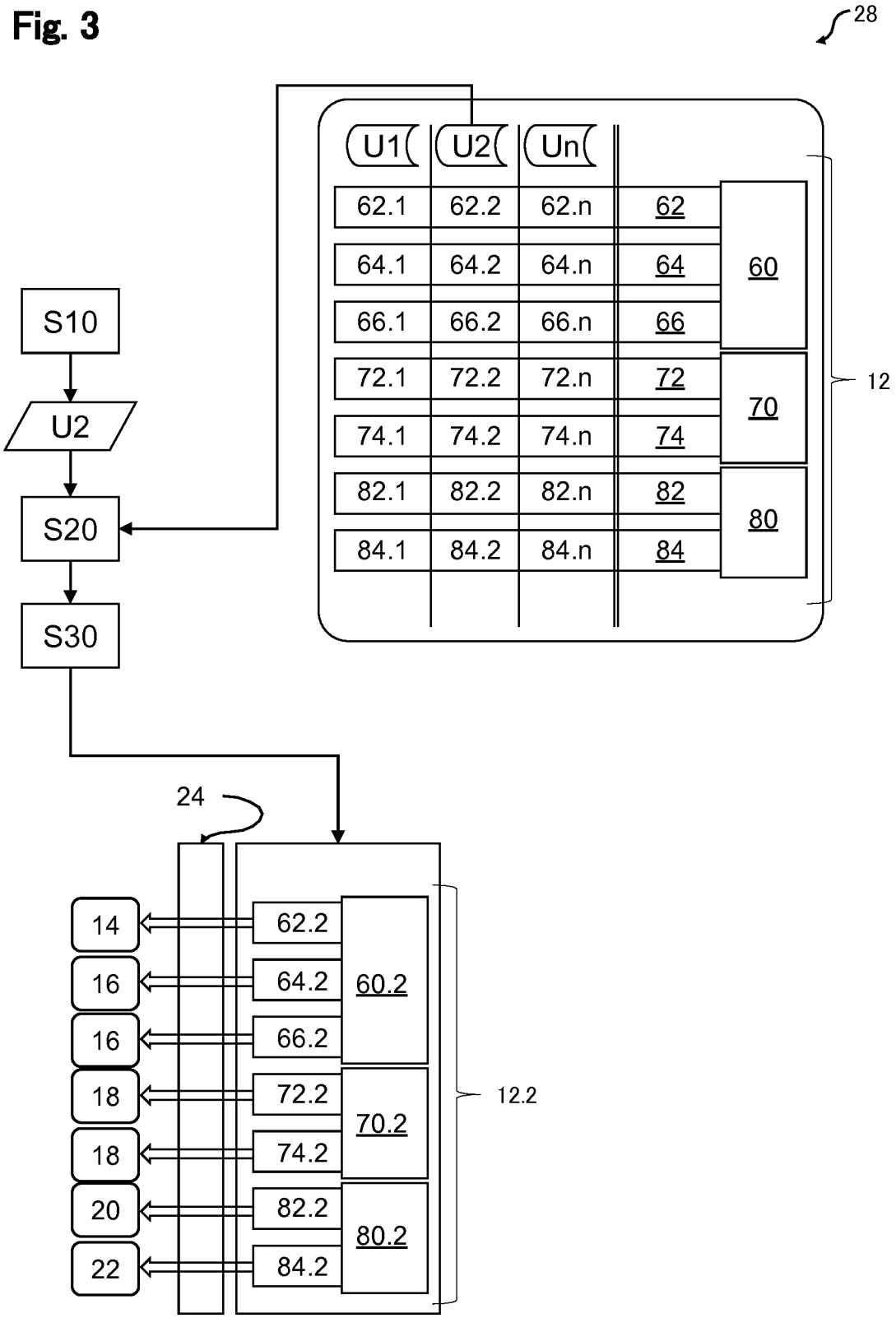
FIG. 3 is a flow chart depicting steps of an exemplary method of operating the stair lifts of FIGS. 1 and 2.
Figure 4:
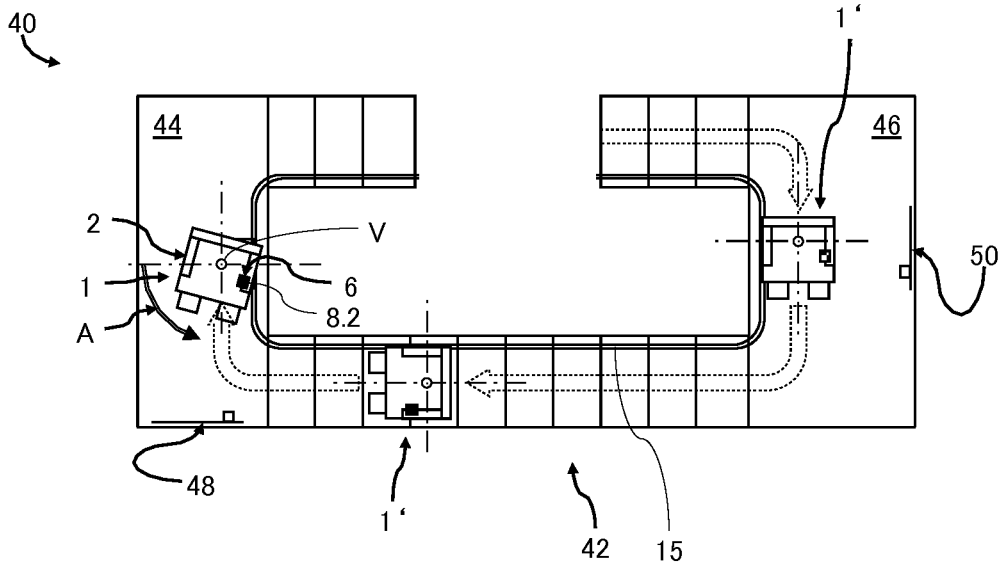
FIG. 4*a* is a top view depicting the stair lift of FIGS. 1 and 2, operated by the method of FIG. 3, for a first user.
FIG. 4*b* is a top view depicting the stair lift of FIGS. 1 and 2, operated by the method of FIG. 3, for a second user.
Figure 4:
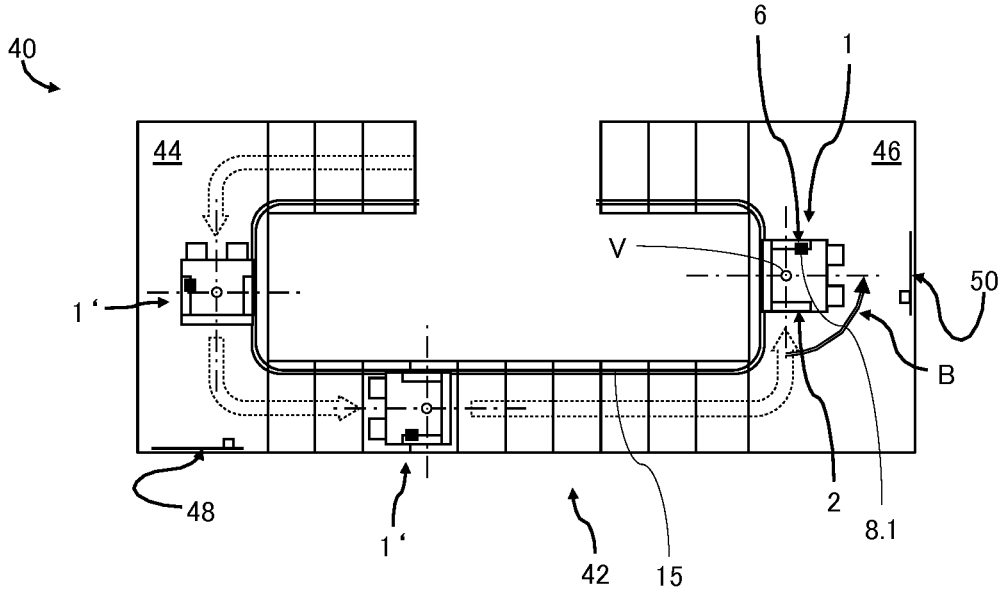

The stair lift also comprises an authentication device 4 for comprising a signal receiver 6 and a number of signal emitters 8, wherein each emitter 8.1, 8.2, **8.*n* is assigned to a different user U1, U2, Un (c.f. FIGS. 3 and 4) of the stair lift 1. In the exemplary embodiment, the signal receiver 6 is an RFID tag reader, and the signal emitters 8 are RFID tags that can be authenticated by the RFID tag reader 6**.

The stair lift further comprises operation adjustment means for generating a behavioral profile 12 of a stair lift 1, particularly of the user carrier 2. The operation adjustment means comprise a rail drive 14 for driving the user carrier 2 alongside the guiding rail 15 of the stair lift 1, a swivelling and tilting drive 16 for swivelling and tilting the user carrier 2 with respect to a lift body 17 connecting to the guiding rail 15 via the rail drive 14. The operation adjustment means further comprise lighting 18 for lighting the stair case in which the user carrier 2 travels, at least one speaker 20 for communication from the stair lift to the user, and a user interface 22 for entering commands by the user and/or displaying information to the user and/or emergency assistance personnel.

Stair lift 1 further comprises a control unit 24 for controlling the stair lift 1. Control unit 24 comprises an authentication controller 26 which is connected to the signal receiver 6, to a database 28 and to an operation controller 30.

In database 28, user profiles (c.f. reference signs U1, U2 and Un) are stored, each of which is linked to one of the signal emitters 8, wherein each of the signal emitters 8.1, 8.2, **8.*n* is assigned to a different user U1, U2** or Un.

The operation controller 30 is connected to the operation adjustment means 14, 16, 18, 20 and/or 22, and is configured to apply control commands to each of these operation adjustment means.

The control unit 24 is also arranged to adjust the behavioral profile 12 (c.f. FIG. 3) of the stair lift 1 depending on which of the signal emitters 8.1, 8.2 or **8.*n* have been authenticated by the authentication device 4 using signal receiver 6**.

The stair lift 1 can be moved through a stair case 40 in both directions along the guiding rail 15, following a rail axis R using the rail drive 14.

By deployment of the swivelling and tilting drive 16, the user carrier 2 can perform a swivelling movement 32 around its vertical axis V. User carrier 2 can also perform tilting movements 34, 36 around its orthogonal horizontal axes H1 and H2.

Figure 2:
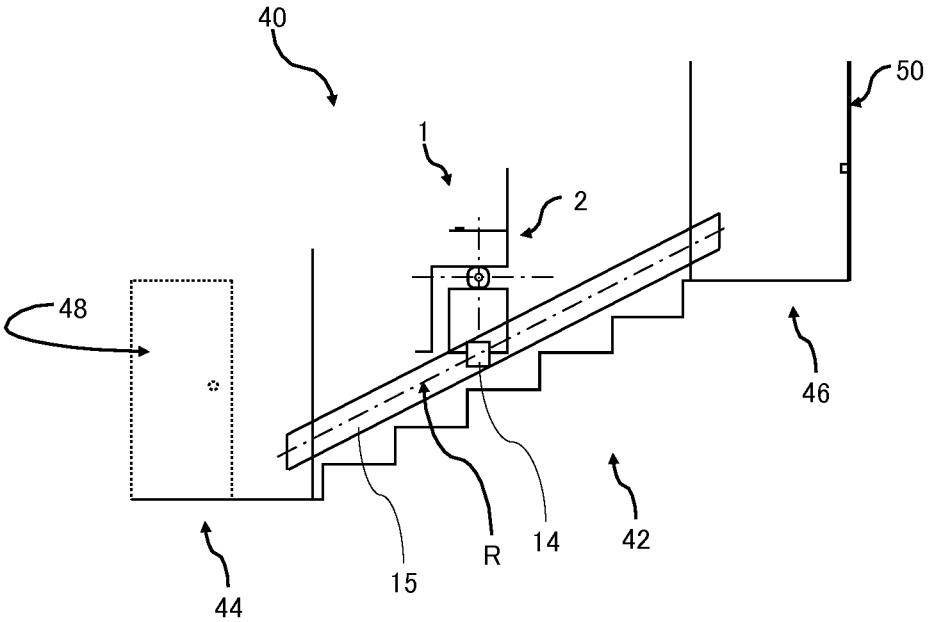
FIG. 2 is a schematic side view of the stair lift of FIG. 1, shown installed at an exemplary flight of an exemplary staircase.

FIG. 2 shows the stair lift 1 of FIG. 1 in an exemplary installation environment, wherein the installation environment is a stair case 40. In FIG. 2, one flight 42 between a lower floor 44 and an upper floor 46 is depicted. The figure shows a first apartment front door 48 on the left side of the user carrier 2 on the lower floor 44. It also shows a second apartment door 50 on the rear side of the user carrier 2 on the higher floor 46.

Stair case 40 comprises several additional flights of stairs, that are not depicted in FIG. 2. Stair lift 1 can travel throughout the stair case 40 along the guiding rail 15 and its axes R, wherein the guiding rail is particularly mounted in a typical way for known stairlifts (see also FIG. 4). In FIGS. 3 and 4, an exemplary embodiment of a method of operating the stair lift according to FIGS. 1 and 2 is described.

FIG. 3 particularly depicts the logic within the control unit 24 when performing the method; FIGS. **4*a* and 4*b* depict two examples of performing the method for different authenticated users U1, U2**.

In step S10, the current user of the stair lift 1 is authenticated. Therefore, the signal receiver 6 of authentication device 4 is in a receive mode. Once a signal emitter 8 is placed in receive area, authentication controller 26 detects the corresponding user. In the example of FIG. 3, user U2 is authenticated.

In step S20, a user profile of the authenticated user U2 is loaded (i.e. made available) to the operation controller 30. The user profile of user U2 is one several user profiles stored in database 28. Each of the user profiles comprises the preferences of the respective user for a movement profile 60, a surroundings profile 70 and/or an interaction profile 80. A movement profile 60 comprises a stair lift speed profile 62, a swivelling profile 64 of the user carrier 2 and/or a tilting profile 66 of the user carrier. The surroundings profile 70 of the stair lift 1 comprises a lighting brightness profile 72 and a lighting pattern 74. The interaction profile 80 of the stair lift comprises emergency details 82 and/or a voice signal profile 84.

With the user profile user U2 loaded in step S20, step S30 is applied. In step S30 the behavioral profile 12 of the stair lift 1 is adjusted by applying the preferences stored in user profile U2 to the operation adjustment means 14, 16, 18, 20 and 22 via the control unit 24.

Thereby, the operation of stair lift 1 can be adjusted to the needs, preferences and/or requirements of the user U2.

In FIG. 4, different swivelling profiles 64 are depicted for the preferences of user 2 (FIG. **4*a*) and user 1 (FIG. 4*b***).

Stair case 40 of FIG. 2 is depicted in FIG. 4 from a top view perspective. In each of FIGS. 4*a* and 4*b*, the stair lift 1 is shown at a position on floor 44, at a position in stair case flight 42 and at a position on floor 46.

In FIG. 4*a*, the user profile of user U2 is applied (as in FIG. 3), since the signal emitter 8.2 personalized for user U2 is currently authenticated.

User U2 lives on floor 44 in the apartment with front door 48. Therefore, the swivelling profile 64.2 of user U2 comprises swivelling the user carrier 2 around the vertical axis V towards door 48 in order to facilitate an easy getting off the user carrier 2 for the user U2. This swivelling movement is indicated by arrow A. In contrast, on floor 46—where user U2 normally does not exit the user carrier 2, no swivelling will take place, according to swivelling profile 46.2.

In FIG. 4*b*, user U1 is authenticated as current user of the stair lift 1, since the signal emitter 8.1 personalized for user U1 is currently authenticated. User U1 has different preferences, so a different swivelling profile 64.1 applies.

Since user 1 lives on floor 46 in the apartment with front door 50, in this case it is on floor 46, that swivelling around vertical axis V takes place towards door 50 in order to facilitate easy exiting. This swivelling movement is indicated by arrow B. On floor 44 in contrast, no swivelling takes place, because such swivelling is not provided in swivelling profile 64.1.

LIST OF REFERENCE SIGNS

1 stair lift
2 user carrier (e.g. chair, wheelchair platform, stair walker)
4 authentication device
6 signal receiver
8 signal emitter
12 behavioral profile
14 rail drive
15 guiding rail
16 swivelling and tilting drive
17 lift body
18 lighting
20 speaker
22 user interface
24 control unit
26 authentication controller
28 database
30 operation controller
32 swivelling movement
34, 36 tilting movement
40 staircase
42 flight of the staircase
44 lower floor
46 upper floor
48 apartment front door on the lower floor
50 apartment front door on the upper floor
60 movement profile
62 stair lift speed profile
64 swivelling profile
66 tilting profile
70 surroundings profile
72 lighting brightness profile
74 lighting pattern
80 interaction profile
82 emergency details
84 voice signal profile
U user (or user profile)
R longitudinal axis of the guiding rail
H1, H2 horizontal axes of the swivelling and tilting drive
V vertical axis of the swivelling and tilting drive

What is claimed is:

1. A stair lift, comprising:
a movable user carrier;
an authentication device comprising,
a signal receiver, and
at least two signal emitters configured to emit a signal to be authenticated by said signal receiver, wherein each signal emitter is assigned to a different user of the stairlift;
operation adjustment assembly configured to generate a behavioral profile of the stair lift, the behavioral profile includes a movement profile, an interaction profile and a surroundings profile of the stairlift, the movement profile comprises adjusting a swivel profile and a tilt profile of the moveable user carrier based on a user physical characteristic to avoid undesirable collisions; and
a control unit configured to control the stairlift and adjust the behavioral profile of the stairlift based on which one of the at least two signal emitters is authenticated by the authentication device.

2. The stair lift of claim 1, wherein the operation adjustment assembly comprises one or more of:
movement adjustment device configured to generate the movement profile for use by the user carrier;
interaction adjustment device configured to generate the interaction profile of the user carrier, the interaction profile including adjusting one or more of emergency details and a voice signal profile; and
surroundings adjustment device configured to generate the surroundings profile of said user carrier.

3. The stair lift of claim 1, wherein said user carrier comprises at least one of a chair, a wheelchair platform, and a standing platform.

4. The stair lift of claim 1, wherein said signal receiver is an RFID tag reader, and said at least two signal emitters are RFID tags, wherein each of the RFID tags has a different ID.

5. The stair lift of claim 1, wherein said signal receiver is disposed on said user carrier.

6. A method of operating the stair lift of claim 1, comprising:
authenticating one of said at least two signal emitters assigned to a first user;
adjusting the behavioral profile of the stair lift according to a stored operation profile associated with the authenticated signal emitter.

7. The method of claim 6, wherein said step of adjusting the behavioral profile of the stair lift comprises:
adjusting a movement profile of the stair lift.

8. The method of claim 7, wherein said step of adjusting the movement profile comprises adjusting a stair lift speed profile between a plurality of speed patterns based on in-flight travel and on-floor travel.

9. The method of claim 8, wherein the stair lift speed profile further comprises a stop at the designated arrival floor.

10. The method of claim 6, wherein said step of adjusting the behavioral profile of the stair lift comprises:
adjusting a surroundings profile of the stair lift.

11. The method of claim 10, wherein said step of adjusting the surroundings profile of the stairlift comprises adjusting at least one of a brightness profile and a lighting pattern of a stairlift lighting.

12. The method of claim 6, wherein said step of adjusting the behavioral profile of the stair lift comprises:
adjusting an interaction profile of the stair lift.

13. The method of claim 12, wherein said step of adjusting an interaction profile of the stair lift comprises, at least one of adjusting emergency details to those corresponding to the authenticated signal emitter of said first user, and adjusting a voice signal profile to that corresponding to the authenticated signal emitter of said first user.

14. The method of claim 1, wherein the movement profile is adjusted during in-flight travel based on the user physical characteristic to avoid the undesirable collisions.

15. The method of claim 14, wherein the movement profile is adjusted during in-flight travel based on an environmental characteristic to avoid the undesirable collisions.

16. The method of claim 1, wherein adjusting of the swivel profile causes a swiveling movement of the movable user carrier during the in-flight travel.

17. The method of claim 1, wherein adjusting of the tilt profile causes a tilting movement of the movable user carrier during the in-flight travel.

* * * * *